US010510479B2

(12) United States Patent
Ida et al.

(10) Patent No.: US 10,510,479 B2
(45) Date of Patent: Dec. 17, 2019

(54) ELECTRONIC COMPONENT AND MANUFACTURING METHOD THEREOF

(71) Applicant: Murata Manufacturing Co., Ltd., Kyoto (JP)

(72) Inventors: Koichi Ida, Nagaokakyo (JP); Shun Ozaki, Nagaokakyo (JP); Hou Muramoto, Nagaokakyo (JP); Isao Ida, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/791,457

(22) Filed: Oct. 24, 2017

(65) Prior Publication Data

US 2018/0114631 A1 Apr. 26, 2018

(30) Foreign Application Priority Data

Oct. 26, 2016 (JP) ..... 2016-209621

(51) Int. Cl.
*H01F 17/04* (2006.01)
*H01F 27/32* (2006.01)
(Continued)

(52) U.S. Cl.
CPC ..... *H01F 27/324* (2013.01); *H01F 27/255* (2013.01); *H01F 41/06* (2013.01); *H01F 41/125* (2013.01); *H01F 27/2823* (2013.01)

(58) Field of Classification Search
CPC ... H01F 27/324; H01F 27/2823; H01F 27/255
(Continued)

(56) References Cited

U.S. PATENT DOCUMENTS 5,750,257 A * 5/1998 Doshita ..... C09D 179/08 174/110 N
6,198,373 B1 * 3/2001 Ogawa ..... H01F 17/0033 336/83
(Continued)

FOREIGN PATENT DOCUMENTS

CN 103003896 A 3/2013
CN 105684111 A 6/2016
(Continued)

OTHER PUBLICATIONS

An Office Action mailed by the Korean Intellectual Property Office dated Dec. 5, 2018, which corresponds to Korean Patent Application No. 10-2017-0139278 and is related to U.S. Appl. No. 15/791,457 with English language translation.
(Continued)

*Primary Examiner* — Tszfung J Chan
(74) *Attorney, Agent, or Firm* — Studebaker & Brackett PC

(57) ABSTRACT

An electronic component includes a coil, or a coiled conductor, and a molded body including a sealant containing resin and magnetic powder, and encapsulating the coil. The coil is coated with a cured product of a thermosetting composition, and the coated body is embedded in the molded body. A method of manufacturing the electronic component includes forming a coil by winding a conductor, applying a thermosetting composition on the coil, heat treating the coil on which the composition is applied to obtain a coated body, embedding the coated body into a sealant containing resin and magnetic powder, and applying pressure to the sealant to form a molded body.

6 Claims, 3 Drawing Sheets

(51) Int. Cl.

| | |
|---|---|
| ***H01F 27/255*** | (2006.01) |
| ***H01F 41/06*** | (2016.01) |
| ***H01F 41/12*** | (2006.01) |
| *H01F 27/28* | (2006.01) |

(58) Field of Classification Search
USPC ..... 336/200, 232
See application file for complete search history.

(56) References Cited

U.S. PATENT DOCUMENTS

| | | | | |
|---|---|---|---|---|
| 2003/0035960 | A1* | 2/2003 | Tsunoda | B32B 27/20 428/413 |
| 2012/0318555 | A1* | 12/2012 | Ushiwata | C09D 179/08 174/110 SR |
| 2014/0022039 | A1* | 1/2014 | Weinberg | H01B 3/105 336/94 |
| 2015/0069877 | A1* | 3/2015 | Otowa | H01B 3/40 310/208 |
| 2016/0322126 | A1* | 11/2016 | Oya | H01F 5/06 |
| 2016/0322153 | A1 | 11/2016 | Kawachi et al. | |
| 2016/0365164 | A1* | 12/2016 | Fukuda | H01B 3/308 |

FOREIGN PATENT DOCUMENTS

| | | | | | |
|---|---|---|---|---|---|
| JP | 01144604 | A | * | 6/1989 | |
| JP | H09-120926 | A | | 5/1997 | |
| JP | 2001-288334 | A | | 10/2001 | |
| JP | 2004-031883 | A | | 1/2004 | |
| JP | 2006-253272 | A | | 9/2006 | |
| JP | 2010-238929 | A | | 10/2010 | |
| JP | 2010-245473 | A | | 10/2010 | |
| JP | 2010238929 | A | * | 10/2010 | |
| JP | 2012-039098 | A | | 2/2012 | |
| JP | 2012-089595 | A | | 5/2012 | |
| JP | 2015-083663 | A | | 4/2015 | |
| JP | 2015-126201 | A | | 7/2015 | |
| JP | 2015126201 | A | * | 7/2015 | H01F 27/2852 |
| KR | 2016-0045103 | A | | 4/2016 | |

OTHER PUBLICATIONS

An Office Action; "Notification of Reasons for Refusal," Mailed by the Japanese Patent Office dated Jan. 29, 2019, which corresponds to Japanese Patent Application No. 2016-209621 and is related to U.S. Appl. No. 15/791,457; with English language translation.

An Office Action mailed by the Chinese Patent Office dated May 27, 2019, which corresponds to Chinese Patent Application No. 201710992524.7 and is related to U.S. Appl. No. 15/791,457 with English language translation.

* cited by examiner

ELECTRONIC COMPONENT AND MANUFACTURING METHOD THEREOF

CROSS REFERENCE TO RELATED APPLICATIONS

This application claims benefit of priority to Japanese Patent Application 2016-209621 filed Oct. 26, 2016, the entire content of which is incorporated herein by reference.

TECHNICAL FIELD

The present disclosure relates to an electronic component and a method of manufacturing the electronic component.

BACKGROUND

As described in Japanese Patent Application Publication No. 2010-245473, electronic components known in the art include inductors manufactured by forming a coil by winding a conductive wire that includes a conductor and an insulator covering the surface of the conductor, embedding the coil into a sealant containing resin and magnetic powder, pressure-molding the sealant to form a molded body, and connecting both ends of the coil with external terminals formed on the surface of the molded body.

SUMMARY

The present disclosure provides an electric component and manufacturing method thereof. An electronic component includes a coil, or a coiled conductor, and a molded body including a sealant containing resin and magnetic powder, and encapsulating the coil. The coil is coated with a cured product of a thermosetting composition, and the coated body is embedded in the molded body. A method of manufacturing the electronic component includes forming a coil by winding a conductor, applying a thermosetting composition on the coil, heat treating the coil on which the composition is applied to obtain a coated body, embedding the coated body into a sealant containing resin and magnetic powder, and applying pressure to the sealant to form a molded body.

DETAILED DESCRIPTION

Figure 1:
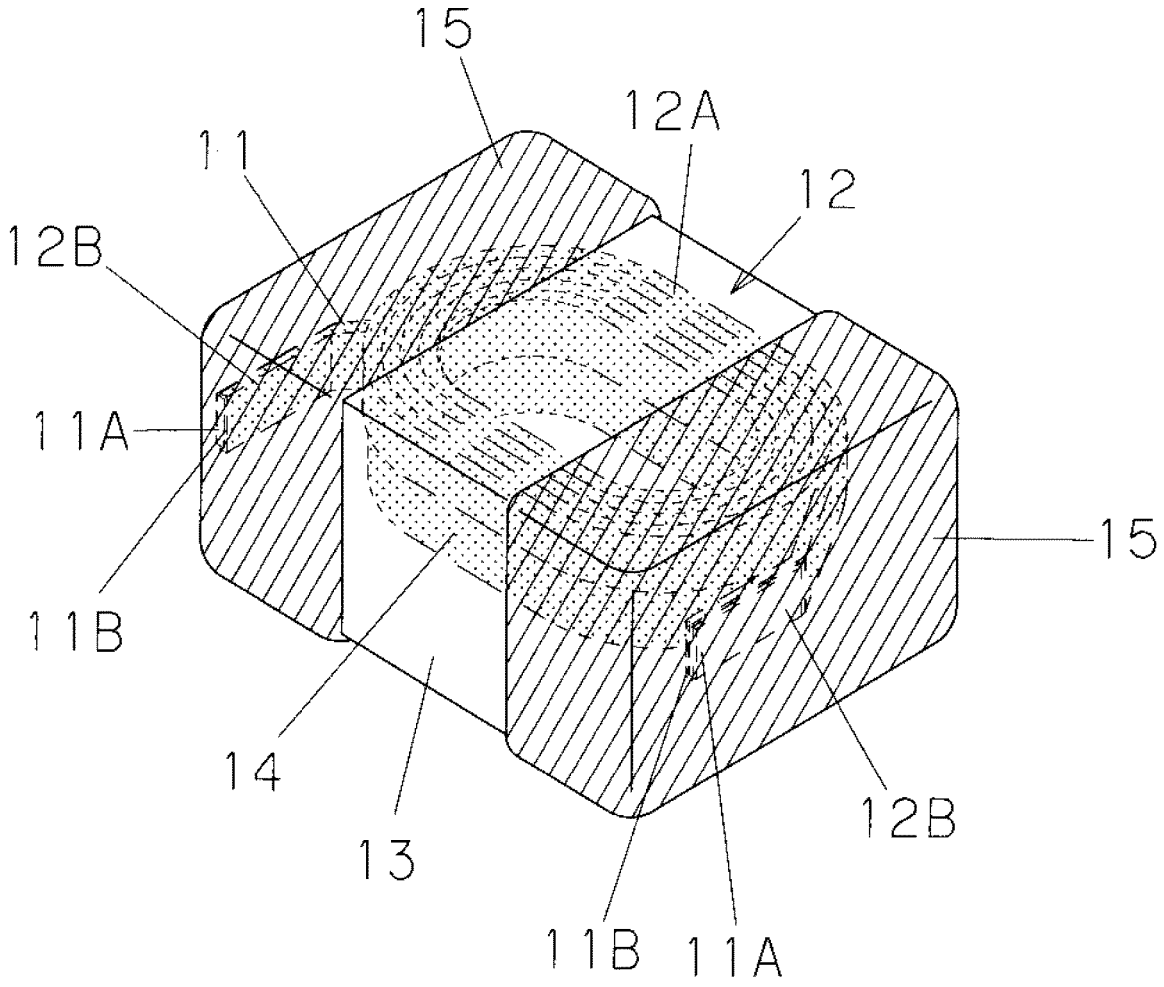
FIG. 1 is a perspective view of an electronic component according to an embodiment of the present disclosure.

In a conventional electronic component, as the pressure applied to form a molded body is increased, the filling rate of magnetic powder increases, and the properties can be improved. However, when the pressure for forming a molded body is increased in the conventional electronic component, the increased pressure may cause the magnetic powder contained in the molded body to pierce the insulator on the surface of the conductive wire of the coil. This may cause short circuit among the conductive wire.

In response to such an issue, the thickness of the insulator on the surface of the conductor may be increased. However, this reduces the volume of the area for the magnetic powder in the molded body by the amount of increase in the thickness of the insulator. This reduction can result in insufficient properties.

One or more aspects of the present disclosure are directed to an electronic component having a high filling rate of magnetic powder without reduction in volume of the area for the magnetic powder, and improved properties, and a method of manufacturing the electronic component.

One aspect of the present disclosure is an electronic component including a coil, or a coiled conductor, and a molded body including a sealant containing resin and magnetic powder, and encapsulating the coil. The coil is coated with a cured product of a thermosetting composition, and the coated body is embedded in the molded body.

Another aspect of the present disclosure is a method of manufacturing an electronic component including a coil, or a coiled conductor, and a molded body including a sealant containing resin and magnetic powder, and encapsulating the coil. The method includes the steps of forming a coil by winding a conductor, applying a thermosetting composition on the coil, heat treating the coil on which the composition is applied to obtain a coated body, embedding the coated body into a sealant containing resin and magnetic powder, and applying pressure to the sealant to form a molded body.

One aspect of the present disclosure is an electronic component including a coil, or a coiled conductor, and a molded body including a sealant containing resin and magnetic powder, and encapsulating the coil. As the coil is embedded into the molded body with the surface of the coil being coated with a cured product of a thermosetting composition, the filling rate of the magnetic powder is increased without reducing the volume of the area for the magnetic powder in the molded body, and the properties can be improved.

Another aspect of the present disclosure is a method of manufacturing an electronic component including a coil, or a coiled conductor, and a molded body including a sealant containing resin and magnetic powder, and encapsulating the coil. The method includes the steps of forming a coil by winding a conductor, applying a thermosetting composition on the surface of the coil, heat treating the coil on which the composition is applied to obtain a coated body, embedding the coated body into a sealant containing resin and magnetic powder, and applying pressure to the sealant to form a molded body. The method can provide an electronic component having a high filling rate of magnetic powder without reducing the volume of the area for magnetic powder in the molded body, and having improved properties.

As used herein, the term "step" means not only an independent step but also a step which cannot be clearly distinguished from the other steps but that can achieve the desired object. For the amount of each component contained in a composition, when a plurality of substances corresponding to the component are present in the composition, the amount of the component means the total amount of the substances present in the composition unless otherwise specified.

An electronic component according to an embodiment of the present disclosure includes a coil, or a coiled conductor, and a molded body including a sealant containing resin and magnetic powder, and encapsulating the coil. The surface of the coil is coated with a cured product of a thermosetting composition, forming a coated body. The coated body including the coil having its surface coated with the cured product of the thermosetting composition is embedded in the molded body.

In a method of manufacturing an electronic component according to an embodiment of the present disclosure, a coil is formed by winding a conductor. A thermosetting composition is then applied to the surface of the coil, and heat treated to form a coated body. The coated body is embedded into a sealant containing resin and magnetic powder, to which a pressure is applied to form a molded body. The compression formation of the molded body may be performed with heating.

As described above, in the electronic component and the method of manufacturing the electronic component according to one or more embodiments of the present disclosure, the surface of the coil, or the coiled conductor, is coated with a cured product of a thermosetting composition. The cured product covers cracks that may have originally existed in the conductor, or cracks that may have been caused when forming the coil by winding the conductor. This further improves the withstanding voltage of the electronic component. Further, in the electronic component and the method of manufacturing the electronic component according to one or more embodiments of the present disclosure, as the surface of the coil is covered with a cured product of a thermosetting composition, the cured product does not soften when compressed to form a molded body. Thus, the friction resistance between the sealant containing resin and magnetic powder and the cured product covering the surface of the coil is lower than the friction resistance according to conventional methods of manufacturing electronic components. The sealant containing resin and magnetic powder thus has improved fluidity. For example, the volume of the area for magnetic powder in the molded body is increased by the pressure of the sealant, and/or the filling density of the magnetic powder improves, resulting in further increased inductance.

Electronic Component

The electronic component includes a coated body of a coil, or a coiled conductor, and a molded body. The coil is coated with a cured body of a thermosetting composition. The molded body includes a sealant containing resin and magnetic powder, and encapsulates the coated body.

For the thermosetting composition, any thermosetting composition that generates an insulating material as a cured product when heat treated may be used. The thermosetting composition may contain, for example, at least one thermosetting compound selected from the group consisting of an oxide sol, a hybrid sol, and a thermosetting resin. Using a specific compound as a thermosetting composition produces an electronic component having further improved properties. The thermosetting composition may further contain a liquid medium, such as water or alcohol.

Examples of the oxide sol includes sols containing a metal oxide, such as aluminum oxide sol, silicon oxide sol, titanium oxide sol, or zirconia oxide sol, or a metal hydroxide, and at least one of aluminum oxide sol and silicon oxide sol is preferably contained. A commercially available oxide sol can be used. Examples of the commercially available oxide sol include CSA-110AD by Kawaken Fine Chemicals and X-500PA by DSB.

Examples of the hybrid sol include sols containing an organic and inorganic complex compound. Specific examples include polydimethylsiloxane (PDMS) sols and tetraethylorthosilicate (TEOS) sols. A commercially available hybrid sol can be used.

Examples of the thermosetting resin include epoxy resin, phenol resin, melamine resin, urea resin, alkyd resin, and polyimide resin. For the thermosetting resin, for example, the same resin as the resin contained in the sealant can be used. A commercially available thermosetting resin can be used. Specific examples of the commercially available thermosetting resin include EM-0434AN by Adeka.

The thermosetting compound content of the thermosetting composition may be appropriately adjusted to allow the cured product for covering the coil to have a desired thickness. For example, the content may be from 5% by weight to 30% by weight.

The thermosetting composition may further contain nanoceramic particles. The thermosetting composition containing nanoceramic particles allows easier adjustment of, for example, the adhesion of the cured product to the coil as well as the flexibility, the hardness, and the mechanical strength of the cured product to achieve further improved properties. The nanoceramic particles are particles of an inorganic compound, such as oxide, carbide, nitride, or boride, and have an average particle diameter of less than 1 μm. Specific examples of the nanoceramic particles include nano-alumina particles, nano-silica particles, nano-titanium particles, and nano-zirconia particles. The average particle diameter of the nanoceramic particles may be, for example, from 1 nm to 500 nm, and preferably from 1 nm to 100 nm.

The nanoceramic particle content of the thermosetting composition may be appropriately adjusted to allow the cured product for covering the coil to have desired properties, and is, for example, from 0.15% by weight to 15% by weight.

The thermosetting composition may further contain an additive, such as a surface treatment agent (e.g., a silane coupling agent), a surfactant, an adhesion promoter, a viscosity modifier, a pH adjuster, a lubricant, a stabilizer, a colorant, a fluorescent agent, or a flame retardant as appropriate. The types and contents of these additives may be appropriately selected in accordance with, for example, the purpose.

The thickness of the cured product of the thermosetting composition for covering the coil can be, for example, from 0.2 μm to 10 μm. The thickness may be from 1 μm or more, or 2 μm or more, and 5 μm or less or 3 μm or less. The thickness of the cured product is obtained as an arithmetic mean value of the thicknesses of five to ten sites arbitrarily selected excluding areas where the thickness extremely varies in cross sectional observation using a scanning electron microscope (SEM). The cured product having a thickness in a predetermined range produces, for example, an improved withstanding voltage.

The conductor for forming the coil may be a coated conductor having its surface coated with a thermoplastic resin. Using a coated conductor can achieve a further improved withstanding voltage. For the thermoplastic resin, any thermoplastic resin with insulation properties may be used. The thermoplastic resin may contain, for example, at least one selected from the group consisting of polyethylene resin, modified polyethylene resin, modified polyolefin resin (excluding modified polyethylene resin), polyurethane resin, polyimide resin, polyamide resin, and polyamide-imide resin. Using a conductor coated with a specific thermoplastic resin can achieve a further improved withstanding voltage. The thermoplastic resin may be applied in the form of an aqueous resin emulsion on the conductor. The coated conductor may be produced by applying a thermoplastic resin on a conductor such as copper, or may be appropriately selected from commercially available products.

The sealant to be included in the molded body contains resin and magnetic powder. Examples of the resin include thermosetting resins, such as epoxy resin and phenol resin, and thermoplastic resins, such as polyethylene resin and polyamide resin. Examples of the magnetic powder include iron metal magnetic powder and ferrite magnetic powder. The sealant may further contain, for example, glass powder as appropriate.

Method of Manufacturing the Electronic Component

The method of manufacturing the electronic component includes the steps of forming a coil by winding a conductor, applying a thermosetting composition on the coil, and then heat treating the coil on which the composition is applied to form a coated body, embedding the coated body into a sealant containing resin and magnetic powder, and applying pressure to the sealant to form a molded body.

The coil is formed by winding a conductor. The winding method may be any of, for example, α winding, gull winding, edgewise winding, and aligning winding.

A thermosetting composition is applied onto the coil and then heat treated to form a film on the surface of the coil to produce a coated body. The thermosetting composition may be coated using, for example, dip coating or spray coating, or a combination of these coating techniques. Dip coating or spray coating allows easy adjustment of the amount of the composition to be applied. The spray coating may be performed in one spraying or multiple sprayings. Heat treating the coil coated with the thermosetting composition allows at least a part of the thermosetting compound contained in the thermosetting composition to form a film containing a cured product through, for example, a crosslinking reaction. The film formed by heat treating may partially contain an uncured portion, or may be cured completely. The state of curing of the film can be estimated, for example, by thermal analysis, such as differential thermal analysis or thermogravimetric analysis.

The film formation by applying and heat treating a thermosetting composition may be performed multiple times as appropriate. Repeating film formation a desired number of times produces a more uniform cured product having a desired thickness, resulting in a further improved withstanding voltage.

After applying the thermosetting composition and before heat treating the composition, dry treatment may be performed to remove at least a portion of the liquid medium contained in the thermosetting composition. The dry treatment may be performed independently of the heat treating, or may be performed continuously. The dry treatment may be performed under ordinary pressure or reduced pressure, and may be performed with heating. The conditions of the dry treatment, such as temperature and time period, may be appropriately selected in accordance with, for example, the composition and the amount of coating of the thermosetting composition.

The amount of coating of the thermosetting composition may be appropriately adjusted to allow the cured product to have a desired thickness. The conditions of heat treating, such as temperature and time period, for forming a cured product may be appropriately selected in accordance with, for example, the composition and the amount of coating of the thermosetting composition. For example, when the conductor for forming the coil is coated with a thermoplastic resin, heat treating may be performed at a temperature of from 80° C. to 250° C.

Before applying a thermosetting composition on the coil, the surface of the coil may be washed with an organic solvent, such as alcohol or acetone, or may be surface-treated with a surface treatment agent, such as a coupling agent or an adhesion promoter, or with radicals from ultraviolet rays or oxygen plasma. This further improves the adhesion of the cured product to the coil, resulting in further improved properties.

The resulting coated body is embedded in a sealant containing resin and magnetic powder, and compressed to form a molded body. For, for example, the constitution of the sealant and the conditions for forming a molded body, those commonly used in this technical field may be applied.

EXAMPLES

Examples of an electronic component and a method of manufacturing the electronic component according to one or more embodiments of the present disclosure will now be described with reference to FIG. 1 and FIGS. 2A, 2B, and 2C. However, the present disclosure is not limited to these examples.

FIG. 1 is a perspective view of an electronic component according to an embodiment of the present disclosure. In FIG. 1, the reference numeral 11 indicates a conductor, 12 indicates a coil, and 13 indicates a molded body. A coil 12 is an air-core coil including a coiled portion 12A and leading ends 12B. The coiled portion 12A is formed by winding a conductive wire 11 spirally and outwardly into two-tiered coiled parts in a manner to allow both ends of the conductive wire 11 to be positioned on the circumference. The leading ends 12B are led out from the coiled portion 12A. In the conductive wire 11, the surface of a conductor 11A having a rectangular cross section is, for example, coated with a thermoplastic resin coating 11B. However, the coil may be formed using a conductor without coating. For the thermoplastic resin coating 11B, for example, polyethylene resin, modified polyethylene resin, modified polyolefin resin, polyurethane resin, polyimide resin, polyamide resin, or polyamide-imide resin may be used. The leading ends 12B are led out to allow both ends of the conductive wire 11 to oppose each other with the coiled portion 12A between them. On the entire surface of the coil 12, a film 14 is formed as a cured product of a thermosetting composition containing a thermosetting compound, such as a thermosetting resin, more specifically, an oxide sol, a hybrid sol, or an epoxy resin.

The molded body 13 is formed using a sealant containing resin and magnetic powder in a manner to encapsulate the coil 12 coated with the coated body, or the coil 12 coated with the film 14. As the magnetic powder, for example, iron metal magnetic powder is used, and as the resin, for example, an epoxy resin is used, and a mixture of these is used as the sealant. On each of the opposing sides of the molded body 13 in its length direction (the direction orthogonal to the winding axis of the coil) a surface of the corresponding leading end 12B of the coil 12 is exposed. From the surface of each leading end 12B exposed on the corresponding side, the film 14 and the coating 11B are removed to expose the conductor 11A on the side. External terminals 15 are formed on the opposing sides of the molded body 13 in its length direction and a part of four surfaces adjacent to the sides, and the conductors 11A of the leading ends 12B of the coil 12 are connected with the external terminals 15.

Figure 2A:
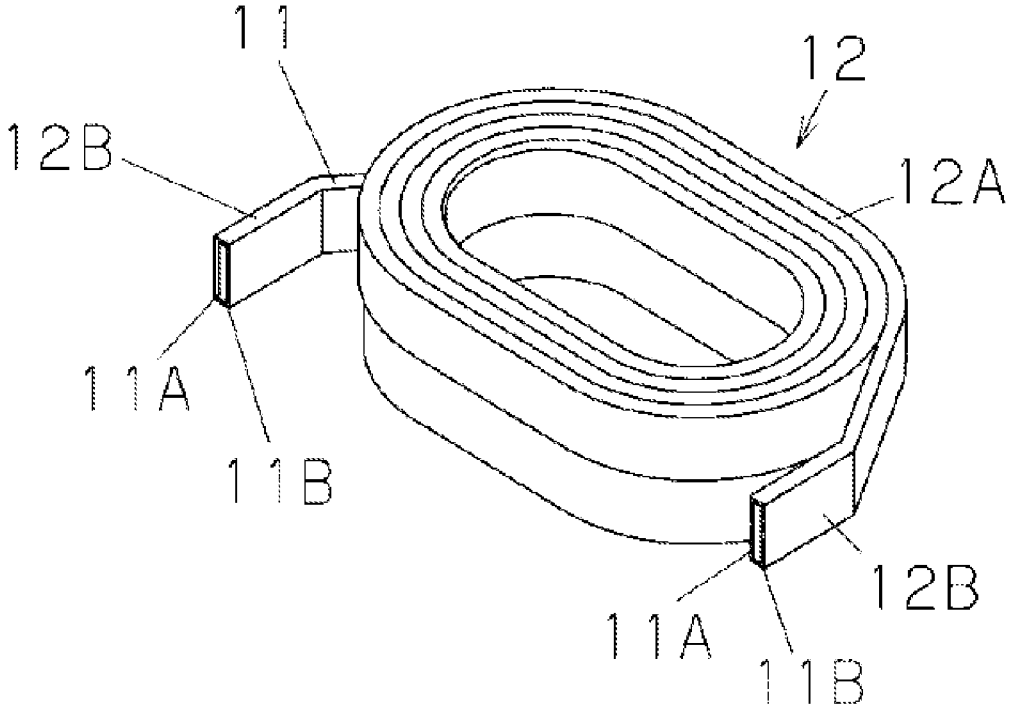
FIGS. 2A, 2B, and 2C are explanatory perspective views of a method of manufacturing an electronic component according to an embodiment of the present disclosure.

The above-described electronic component is manufactured in a manner described below. The conductive wire 11 is formed by coating the surface of the conductor 11A having a rectangular cross section with the coating 11B formed from a thermoplastic resin. The conductive wire 11 is then wound outwardly to form the coiled portion 12A including two-tiered coiled parts in a manner to allow both ends of the conductor wire 11 to be positioned on the circumference. Both ends of the conductor are then led out from the circumference of the coiled portion 12A to form the leading ends 12B. This completes an air-core coil 12 as shown in FIG. 2A. The leading ends 12B are formed by leading out both ends of the conductor from the coiled portion 12A in a manner to oppose each other with the coiled portion 12 between them. For the thermoplastic resin coating 11B for covering the conductive wire 11, for example, polyethylene resin, modified polyethylene resin, modified polyolefin resin, polyurethane resin, polyimide resin, or polyamide polyamide-imide resin may be used.

Figure 2B:
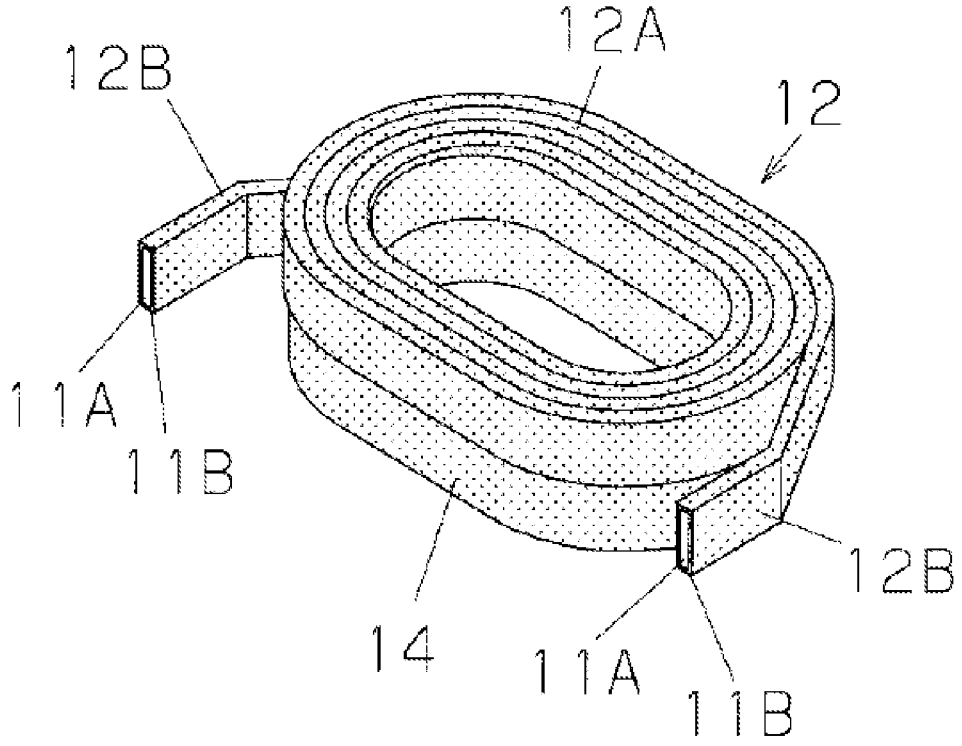

As shown in FIG. 2B, on the entire surface of the air-core coil 12, a thermosetting composition containing a thermosetting compound, such as a thermosetting resin, more specifically, an oxide sol, a hybrid sol, or an epoxy resin, is then applied, dried, and cured to form the film 14 formed from a cured product of the thermosetting composition. The thermosetting composition may be applied by dipping the air-core coil 12 in the thermosetting composition, or spraying the thermosetting composition onto the surface of the air-core coil 12. Applying, drying, and curing of the thermosetting composition may be repeated multiple times as appropriate to allow thin films to be sequentially formed as a cured product of the thermosetting composition on the entire surface of the air-core coil 12. The film 14 is thus formed to have a thickness of, for example, from 0.2 μm to 10 μm.

Figure 2C:
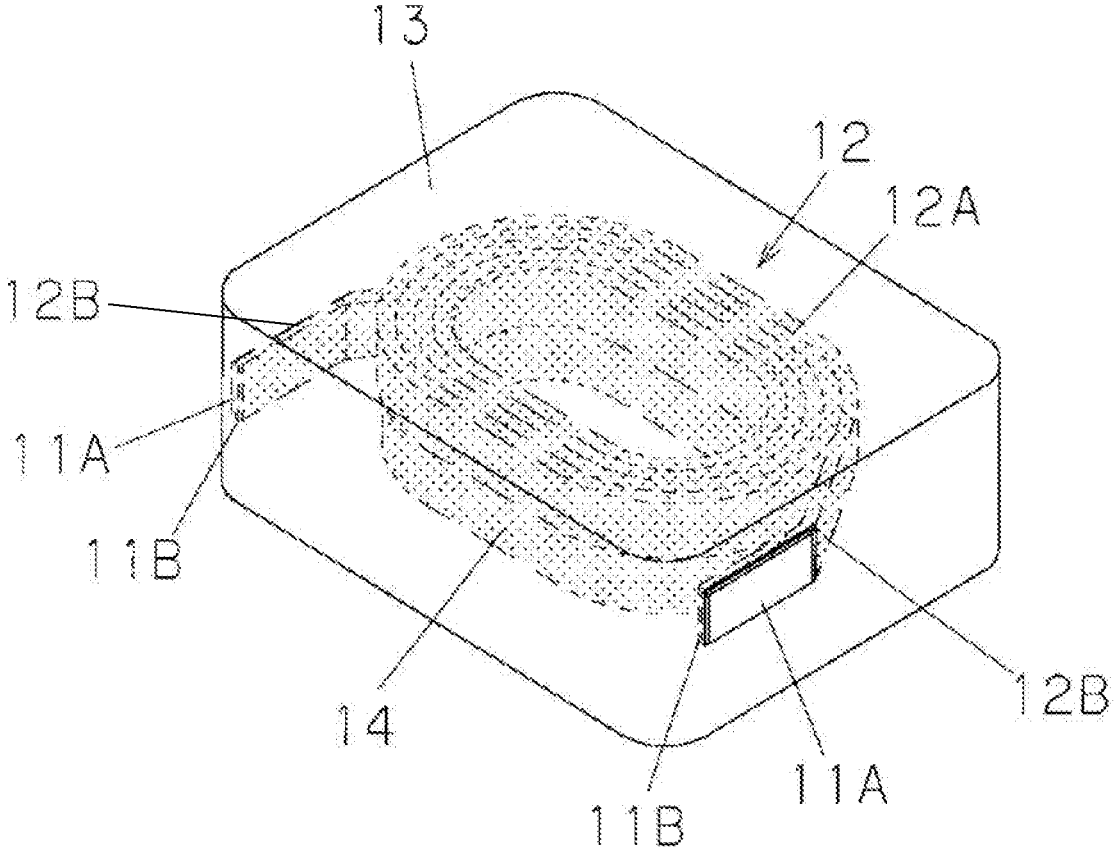

As shown in FIG. 2C, the coil 12 coated with the film 14, or a cured product of the thermosetting composition, is then embedded into a sealant containing resin and magnetic powder, and compressed to form the molded body 13 encapsulating the coil 12. As the magnetic powder, for example, iron metal magnetic powder is used, and as the resin, for example, epoxy resin is used, and a mixture of these is used as the sealant. Each leading end 12B of the coil 12 has a surface exposed on one of the opposing sides of the molded body 13 in its length direction. From the surface of each leading end 12B exposed on the corresponding side, the film 14, which is a cured product of the thermosetting composition, and the coating 11B, which is formed from a thermoplastic resin, are removed to expose the conductor 11A.

The external terminals 15, which are formed from conductive materials, are then arranged on the opposing sides of the molded body 13 in its length direction and a part of four surfaces adjacent to the sides.

The thus formed electronic component including a coil whose surface is covered with a film, or a cured product of a thermosetting composition, has a substantially lower defective rate, unlike the electronic components that are produced using a conventional coil not covered with such a film, and that have a defective rate caused by short circuit of about 25%.

Subsequently, using each thermosetting composition shown below, a film was formed on the coil in accordance with the film forming conditions shown below to prepare a coated body. Using each resulting coated body, an electronic component was formed in the same manner as described above, and the properties were measured. The film was formed by applying the thermosetting composition with dip coating, and heat treating at 200° C. The measured values of the properties are average values of at least 30 samples determined using LCR meter 4285A for inductance L, and our own tester for withstanding voltage.

TABLE 1

| Thermosetting composition | Oxide sol (g) | Ethanol (g) | Surfactant (g) | Adhesion imparting agent (g) |
|---|---|---|---|---|
| A | 50 | 10 | 0.25 | 0.75 |
| B | 50 | 40 | — | — |
| C | 50 | 10 | 0.05 | 0.75 |
| D | 50 | 50 | 0.1 | 0.75 |
| E | 50 | 50 | — | 0.75 |
| F | 50 | 10 | — | 0.75 |

As the oxide sol, CSA110AD (by Kawaken Fine Chemicals) was used, as the surfactant, BYK3440 (by BYK Japan) was used, and as the adhesion imparting agent, BYK4509 (by BYK Japan) was used.

TABLE 2

| | First film formation | Second film formation | Withstanding voltage (V) | Inductance L (μH) | Short circuit rate (%) |
|---|---|---|---|---|---|
| Example 1 | — | — | 106.8 | 0.411 | 23.3 |
| Example 2 | Compositon A | — | 130.6 | 0.420 | 1.9 |
| Example 3 | Compositon B | Composition C | 175.1 | 0.421 | 0.0 |
| Example 4 | Compositon D | Composition D | 127.1 | 0.429 | 6.3 |
| Example 5 | Compositon E | — | 146.3 | 0.439 | 2.4 |
| Example 6 | Compositon F | — | 139.5 | 0.422 | 3.6 |

Example 1 shows properties of a conventional product without the film 14 of a thermosetting composition on the coil 12. Example 2 shows properties of a product where a film is formed by applying a thermosetting composition including the oxide sol and the additives (Composition A) on the entire surface of the coil 12. Example 3 shows properties of a product where a film was formed on the entire surface of the coil 12 by applying a thermosetting composition including the oxide sol with no additives (Composition B), and then applying a thermosetting composition including the oxide sol and the additives (Composition C) on the previously applied Composition B at an identical pulling rate but higher than the pulling rate in Example 2. Example 4 shows properties of a product where a film was formed on the entire surface of the coil 12 by applying a thermosetting composition including the oxide sol and the additives (Composition D) twice by dip coating at the same pulling rate as Example 2. Examples 5 and 6 show properties of a product where a film was formed on the entire surface of the coil 12 by applying a thermosetting composition including the oxide sol and an additive different from the additive of Example 2 (Composition E and Composition F, respectively) at a higher pulling rate than Examples 2 and 3.

In particular, the average value of the withstanding voltage of the electronic component of Example 3 showed an improvement of about 70 V compared to the average value of the withstanding voltage of the conventional product of Example 1. All the products of Examples 2 to 6 show a higher average value of inductance than the conventional product of Example 1. The average value of the inductance of Example 5 showed an improvement of 7% compared to the average value of the conventional electronic component of Example 1.

For the electronic component prepared in Example 2, the thickness of the cured product covering the coil was measured using SEM images, and was found to be about 2 to 3 μm.

Further, coated bodies were prepared by forming films using Composition G containing epoxy resin and Composition H containing modified polyethylene resin, respectively. Using the resulting coated bodies, electronic components were each prepared in the same manner as described above, and the properties were measured. As the epoxy resin, EM434AN (by Adeka) was used, and as the modified polyethylene resin, SD1010 (by Unitika) was used.

TABLE 3

| | Film formation | Withstanding voltage (V) | Inductance L (μH) |
|---|---|---|---|
| Example 7 | Composition G | 131.3 | 0.434 |
| Example 8 | Composition H | 108.5 | 0.410 |

Example 7 shows properties of a product where the film 14 was formed by applying Composition G with dip coating on the surface of the coil 12, and Example 8 shows properties where Composition H was used.

In Example 8, where the coil is coated with a modified polyethylene, which is a thermoplastic resin, the average value of the withstanding voltage was improved compared to the conventional product of Example 1 where the coil is not coated. However, the average value of the inductance was about the same. In contrast, in Example 7, where the coil is coated with epoxy resin, which is a thermosetting resin, both the average value of the withstanding voltage and the average value of the inductance were improved compared to those of Example 1.

The examples of the electronic component and the method of producing the electronic component according to the present disclosure were described above. However, the present disclosure is not limited to these examples. For example, in the examples, the coil was formed by winding a conductor outwardly into two-tiered coiled parts in a manner to allow both ends of the conductor to be positioned on the circumference with the width side of the conductor being in parallel with the winding axis. However, the coil may be formed by winding a conductor outwardly into two-tiered coiled parts in a manner to allow both ends of the conductor to be positioned on the circumference with the thickness side of the conductor being in parallel with the winding axis. Also, the coil may be wound in many other ways including gull winding and aligning winding.

Further, the thermosetting resin may be applied on the entire surface of the coil only once, or three times or more.

Before applying the thermosetting resin on the entire surface of the coil, the whole coil may be washed with an organic solvent.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The exemplary embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An electronic component comprising:

a coil, the coil being a coiled conductor; and a molded body including a sealant containing resin and magnetic powder, the molded body encapsulating the coil, wherein the conductor is a coated conductor having its surface coated with a thermoplastic resin which contains at least one selected from the group consisting of polyethylene resin, modified polyethylene resin, modified polyolefin resin, polyurethane resin, polyimide resin, polyamide resin, and polyamide-imide resin;

wherein the coil includes a coiled portion and leading ends, the coiled portion is formed by winding a conductive wire in a manner to allow both ends of the conductive wire to be positioned on the circumference, and the leading ends are led out from the coil portion, and is embedded in the molded body as a coated body coated with a cured product of a thermosetting composition;

wherein the cured product includes a first film and a second film, the first film being a cured product of a thermosetting composition containing an oxide sol and being formed on a surface of the coiled portion and surfaces of the leading ends, and the second film being a cured product of a thermosetting composition containing an oxide sol and an additive and being formed on a surface of the first film; and wherein a surface of the conductor of the leading end is exposed on an opposing side of the molded body and connected to an external terminal formed on the molded body.

2. The electronic component according to claim 1, wherein the cured product has a thickness of 0.2 μm to 10 μm.

3. The electronic component according to claim 1, wherein the thermosetting composition further contains nanoceramic particles.

4. The electronic component according to claim 3, wherein the nanoceramic particles are 0.15% by weight to 15% by weight of the thermosetting composition, and have an average particle diameter of 1 nm to 100 nm.

5. The electronic component according to claim 1, wherein the oxide sol includes at least one selected from the group consisting of aluminum oxide sol, silicon oxide sol, titanium oxide sol, and zirconia oxide sol.

6. The electronic component according to claim 1, wherein the additive includes at least one selected from the group consisting of a surface treatment agent, a surfactant, an adhesion promoter, a viscosity modifier, a pH adjuster, a lubricant, a stabilizer, a colorant, a fluorescent agent, and a flame retardant.

* * * * *